United States Patent [19]

Freeman

[11] Patent Number: 4,671,738

[45] Date of Patent: Jun. 9, 1987

[54] ROTOR OR STATOR BLADES FOR AN AXIAL FLOW COMPRESSOR

[75] Inventor: Christopher Freeman, Nottingham, England

[73] Assignee: Rolls-Royce plc, London, England

[21] Appl. No.: 746,017

[22] Filed: Jun. 19, 1985

Related U.S. Application Data

[63] Continuation of Ser. No. 536,507, Sep. 28, 1983, abandoned.

[30] Foreign Application Priority Data

Oct. 13, 1982 [GB] United Kingdom ..... 8229286

[51] Int. Cl.[4] ..... F04D 29/38

[52] U.S. Cl. ..... 416/223 A; 416/223 R; 415/181; 415/DIG. 1

[58] Field of Search ..... 415/DIG. 1, 181, 213 C, 415/192, 53 R, 193; 416/223 R, 223 A, DIG. 2, 200 A

[56] References Cited

U.S. PATENT DOCUMENTS

| | | | |
|---|---|---|---|
| 2,451,944 | 10/1948 | Hall | 416/200 A |
| 2,505,755 | 5/1950 | De Ganahl et al. | 416/DIG. 2 X |
| 2,693,905 | 11/1954 | Carter | 415/192 |
| 2,710,136 | 6/1955 | De Ganahl et al. | 415/181 |
| 2,714,499 | 8/1955 | Warner . | |
| 2,746,672 | 5/1956 | Doll, Jr. et al. . | |
| 3,536,417 | 10/1970 | Stiefel et al. | 416/223 A |
| 4,431,376 | 2/1984 | Lubenstein et al. | 416/223 R |
| 4,465,433 | 8/1984 | Bischoff | 415/DIG. 1 |
| 4,470,755 | 9/1984 | Bessay | 415/DIG. 1 |

FOREIGN PATENT DOCUMENTS

| | | | |
|---|---|---|---|
| 2034890 | 2/1971 | Fed. Rep. of Germany . | |
| 268026 | 8/1950 | Switzerland | 416/200 A |
| 644319 | 10/1950 | United Kingdom . | |
| 768026 | 2/1957 | United Kingdom . | |
| 887083 | 1/1962 | United Kingdom . | |
| 908748 | 10/1962 | United Kingdom . | |
| 981188 | 1/1965 | United Kingdom . | |
| 1397179 | 6/1975 | United Kingdom . | |
| 918550 | 4/1982 | U.S.S.R. | 415/53 R |

*Primary Examiner*—Robert E. Garrett
*Assistant Examiner*—John Kwon
*Attorney, Agent, or Firm*—Cushman, Darby & Cushman

[57] ABSTRACT

A rotor or stator blade for an axial flow compressor has one or both of its end portions designed to minimize the interference between the annulus boundary layer and the blade. The basis of the invention is that the aerofoil is designed so that each section of the aerofoil through the boundary layer performs a constant amount of work per unit height.

4 Claims, 2 Drawing Figures

ROTOR OR STATOR BLADES FOR AN AXIAL FLOW COMPRESSOR

This is a continuation of application Ser. No. 536,507, filed Sept. 28, 1983, which was abandoned upon the filing hereof.

This invention relates to a rotor or stator blade for an axial flow compressor, which may for instance be a compressor of a gas turbine engine.

It is obviously desirable that these compressors should be as efficient as possible, and that they should be capable of operating under a wide range of conditions without encountering either of the problems of surge or stall. One of the factors which has deleteriously effected the performance of these compressors comprises the existence of the so-called secondary flows. These flows do not follow the normal design path of fluid through the compressor, but instead move radially up or down the blades or circumferentially along the inner or outer walls of the compressor flow annulus.

The effect of these flows is to produce a build up of the boundary layer in various places, and this build up has been found to lower the surge margin of the compressor. This is clearly undesirable.

For these secondary flows to exist, radial pressure gradients must exist along the blades, and these radial pressure gradients are produced by the interaction between the aerofoils and the boundary layer on the outer and inner walls of the flow annulus of the compressor. We have appreciated that by designing the aerofoils of the blades and vanes to take account of these boundary layers it is possible to reduce or avoid the production of radial pressure gradients, thus reducing or avoiding the secondary flows and their undesirable effects.

According to the present invention a rotor or stator blade for an axial flow compressor comprises an aerofoil made up of a stack of aerofoil sections from one end portion to an opposite end portion and having at least one end portion designed with a variation in aerofoil section such as to produce a constant lift force per unit aerofoil length throughout at least the greater part of the boundary layer in which, in operation, it is immersed.

It will be appreciated that this implies that each rotor aerofoil end portion referred to will also perform a constant amount of work per unit length throughout the depth of the boundary layer, and that the change of whirl produced per unit length of rotor or stator aerofoil in this region will vary inversely with the axial velocity of the fluid.

Preferably the aerofoil sections making up the blade are stacked about their centres of lift rather than about their centroids which is the conventional procedure.

To obtain maximum benefit the blade should have both its inner and outer end portions designed in accordance with the procedure of the present invention.

In the accompanying drawings.

Figure 1:
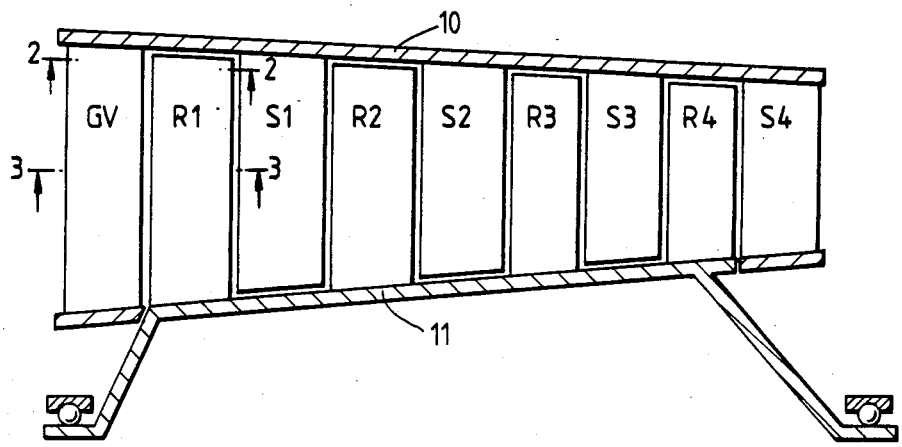
FIG. 1 is a diagrammatic view of part of an axial flow compressor.

FIG. 1 shows diagrammatically a typical axial flow compressor comprising an outer casing 10 defining the outer boundary of a flow annulus and an inner rotor drum 11 defining the inner boundary of the flow annulus. The blading of the compressor comprises a row of inlet guide vanes marked GV followed by four rows of stator vanes marked S1 to S4 inclusive. All these static vanes are supported from the outer static casing 10.

The rotor blades comprise four rows of blades R1 to R4 inclusive, mounted from the rotor drum 11 and alternating with the rows of stators so that R1 lies between GV and S1 and so on.

Overall, operation of the compressor is conventional and is not further described herein. However, it will be appreciated that the various gas-contacting surfaces of the compressor will have boundary layers formed on them, these layers being particularly noticeable on the gas contacting surfaces of the casing 10 and drum 11. Should any radial pressure gradient be caused by the interaction between the blading and the boundary layer, the boundary layer will tend to migrate forming regions of greater thickness. In these regions there is a greater likelihood of flow separation, and hence the onset of surge or other instability in the compressor is hastened. It would therefore be desirable to avoid the asymmetry in the boundary layer caused by the migration of the layer (called 'secondary flow').

The secondary flows in the boundary layer can only be energised by radial pressure differences, hence if these pressure differences are reduced or eliminated the secondary flows will also be reduced or eliminated and the boundary layers on the annulus walls will be allowed to remain symmetrical or substantially so.

In the present invention the aerofoils of the blading are designed to achieve this radial pressure balance. It will be appreciated that if there are no radial pressure gradients, the lift produced by each section of the aerofoil will be the same, since the lift is the summation of the pressure differences over the section and lack of radial pressure gradients implies that the elements of this summation will remain constant. The lift over a sectional element may be defined as $\Delta F_T = m\Delta Vw$ (i) where m is mass flow of gas over the element, and $\Delta Vw$ is the change in whirl velocity of gas flowing over the element.

Mass flow m is proportional to the axial velocity Va of the flow, hence $m = KVa$ (ii) where K is a constant.

Substituting in (i) above, we have $$\Delta F_T = KVa\Delta Vw \quad \text{(iv)}$$

Since $\Delta F_T$ is to be the same for all elements of the aerofoil, we can therefore say for any two elements denoted by suffixes 1 and 2, $$Va1\Delta Vw1 = Va2\Delta Vw2 \quad \text{(v)}$$

or $$Va1/Va2 = \Delta Vw2/\Delta Vw1 \quad \text{(vi)}$$

Stated verbally, the charge in whirl provided by each section of the blade must be inversely proportional to the axial velocity. This axial velocity will of course vary over the aerofoil height principally because of the boundary layer.

Figure 2:
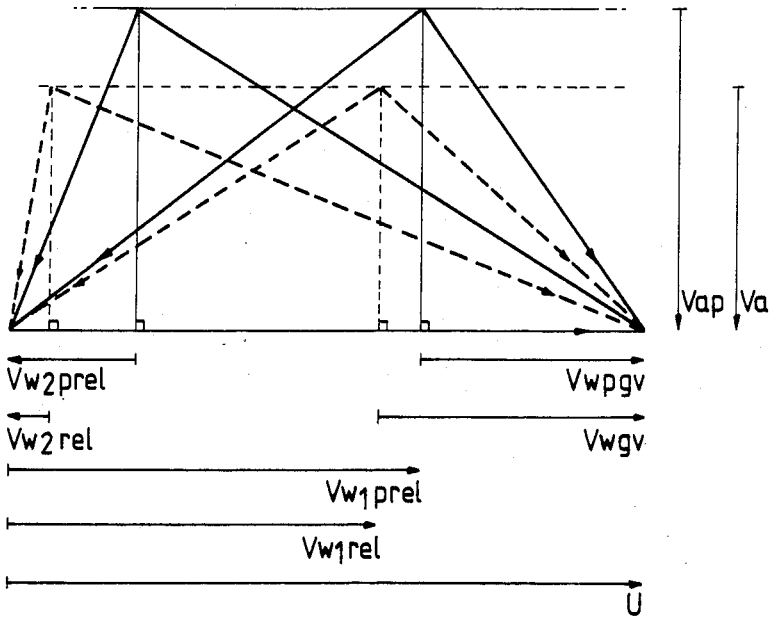
FIG. 2 is a vector triangle diagram for the stations 2—2 and 3—3 of a rotor blade of the compressor of FIG. 1, the full lines representing the values at 2—2 in the free stream and the broken lines representing the values at 3—3 in the boundary layer for a blade form in accordance with the invention.

This simple relationship, together with the conventional treatment of flows in an axial flow compressor, enable the parameters of the aerofoils to be determined in sequence throughout the compressor. Thus, taking the inlet guide vanes and first rotor stage as an example, and referring to the vector triangles of FIG. 2, the normal whirl velocity at the guide vane outlet on the station 3—3 will be defined as Vwpgv (the presence of the suffix p indicating that this is a free-stream parameter). The value of whirl Vwgv at the exit from the guide vanes at station 2—2 in the boundary layer affected region may be calculated from equation (vi) above.

Hence from (vi) we have $$\Delta Vwgv/\Delta Vwpgv = Vap/Va \quad \text{(vii)}$$

Assuming that the inlet whirl to the guide vanes is zero, we can replace ΔVw by Vw in both cases, and hence $$Vwpgv = (VwpgvVap/Va) \quad \text{(viii)}$$

Since the axial velocity profile in the boundary layer is known theoretically or empirically, the value of Vwgv may be calculated for each element of the aerofoil and hence the camber angle variation of the guide vane aerofoil determined. It will be seen from FIG. 2 that Va is less than Vap and that this implies an increase in Vwgv.

For the inlet to the rotor blades, the relative inlet whirl velocity $Vw_{1rel}$ may be related to U, the blade speed and Vwgv, the whirl at the outlet from the guide vanes as follows $$Vw_{1rel} = U - Vwgv \quad \text{(ix) (see FIG. 2)}$$

and substituting from (viii)

$$Vw1rel = U - Wwpgv(Vap/Va) \quad \text{(x)}$$

This enables the variation in inlet angles of the rotor blade to be calculated.

For the rotor outlet conditions we can say from (vii) that $$\Delta Vwrel = \Delta Vwprel \times (Vap/Va) \quad \text{(xi)}$$

or $$Vw1rel - Vw2rel = \Delta Vwprel \times (Vap/Va) \quad \text{(xii)}$$

Hence from (x)

$$Vw2rel = U - Vwpgv(Vap/Va) - \Delta Vwprel(Vap/Va) \quad \text{(xiii)}$$

and the variation in outlet angle is defined.

The inlet whirl to the succeeding stator is simply $$Vw3st = U - Vw2rel = Vwpgv(Vap/Va) + \Delta Vwprel(-Vap/Va) \quad \text{(xiv)}$$

and the outlet whirl from this stator is $$Vw4st = Vw3st - \Delta Vwst \quad \text{(xv)}$$

and from (vii)

$$\Delta Vwst = \Delta Vwpst(Vap/Va) \quad \text{(xvi)}$$

$$\text{hence } Vw4st = Vw3st - \Delta Vwpst \frac{Vap}{Va} \quad \text{(xvii)}$$

-continued $$= Vwpov \frac{Vap}{Va} + \Delta Vwprel \frac{Vap}{Va} - \Delta Vwpst \frac{Vap}{Va}$$

Normally the whirl put in by the rotor is removed by the stator, and $$\Delta Vwpst = \Delta Vwprel \quad \text{(xviii)}$$

This enables (xvii) to become $$Vw4st = Vwpgv(Vap/Va) \quad \text{(xix)}$$

This will be seen to be the same as the whirl introduced by the inlet guide vane (see (viii) above). It is clear that the conditions in the second rotor stage will repeat, but that there will be a net rotation imposed by the inlet guide vanes.

In this way the variation of inlet and outlet angles of each rotor and stator stage may be specified. For any particular aerofoil section this will enable the shape to be specified, and it will be understood by those skilled in the art that the other parameters of the aerofoil sections such as stagger and deflection may be calculated therefrom.

In a representative compressor the geometric changes implied by this way of designing comprise an increase of camber on both rotor and stator but a small decrease in stagger on the rotor and a large increase in stagger on the stator. The reason for the apparently anomalous result is that the inlet guide vane boundary layer increases the whirl so reducing the rotor relative inlet whirl and gives a lower rotor outlet angle. However the IGV inlet whirl which appears after the rotor (see (xix)) appears to the stator as an increase in whirl and thus for a given change in whirl across the stator the outlet angle rises.. Thus the boundary layer reaction is identical to the main stream since the static pressure rise is the same as in the rotor but to achieve it the rotor and stator geometrics differ.

It will be appreciated that the geometry produced is not applicable to the innermost regions of the boundary layer, because as Va tends to 0 various of the other velocities tend to infinity. Clearly it is necessary to suspend the precise application of the theory as the extremities of the aerofoils are approached, and we find that the variation of camber and stagger in the boundary layer region is approximately linear and that this linearity can advantageously be continued in the extreme regions.

Once consequence of using this theory to design a blade or vane is that significant radial projections of the aerofoils may be produced by the relatively large changes in camber and stagger involved. This could produce deleterious radial flows in its own right and in order to minimise this effect it may be advantageous to stack the sections of the aerofoil about their centres of lift rather than about their centroids as is commonly practiced.

It will be appreciated that the boundary layer conditions with which this invention is concerned are applicable in both the root and tip areas of the rotor and stator blades and vanes involved. It is possible to apply the present invention to root and/or tip conditions as desired, although it is clearly preferable to apply it to both root and tip. It will also be understood that it may not be necessary to apply the invention to all stages of a compressor, and that the most benefit is likely to be felt in the higher pressure stages where the thickness of the boundary layer is a greater proportion of the blade or vane height.

Tests we have carried out show that using the present invention it is possible to produce axial flow compressors having a significantly improved efficiency compared with the prior art; thus in particular instances the efficiency was increased from 88.5% to 90%.

I claim:

1. A rotor or stator blade for operation in an axial fluid flow passage of an axial fluid flow compressor, said passage being subject in operation to growth of boundary layers with fluid flow therein which is rotational in character, said fluid flow in said boundary layers having fluid flow whirl and axial velocity components, said blade comprising;

an aerofoil, characterised by said aerofoil comprising a stack of aerofoil sections from one end portion to an opposite end portion thereof, at least one of said end portions being designed to take account of said rotational flow and thereby reduce the production of radial pressure gradients along said aerofoil within said boundary layers, said aerofoil having at least one end portion designed with a variation in said aerofoil sections such as to produce a constant lift force per unit aerofoil length throughout at least the greater part of the boundary layer in which, in operation, it is immersed.

2. A rotor or stator blade for operation in an axial fluid flow passage of an axial fluid flow compressor, said passage being subject in operation to growth of boundary layers with fluid flow therein which is rotational in character, said fluid flow in said boundary layers having fluid flow whirl and axial velocity components, said rotor blade or said stator blade having an aerofoil with radially inner and outer end portions, at least one of said end portions being designed to take account of said rotational flow and thereby reduce the production of radial pressure gradients along said aerofoil within said boundary layers, said aerofoil comprising a stack of aerofoil sections from said inner end portion to said outer end portion thereof, said at least one end portion having a variation in said aerofoil sections wherein throughout at least a greater part of said boundary layer, said end portion producing a constant lift force per unit aerofoil length and a change of fluid flow whirl velocity per unit aerofoil length which varies inversely with the fluid flow axial velocity.

3. A rotor or stator blade for operation in an axial fluid flow passage of an axial fluid flow compressor, said passage being subject in operation to growth of boundary layers with fluid flow therein which is rotational in character, said fluid flow in said boundary layers having fluid flow whirl and axial velocity components, said rotor blade or said stator blade having an aerofoil with radially inner and outer end portions, at least one of said end portions being designed to take account of said rotational flow and thereby reduce production of radial pressure gradients along said aerofoil, said aerofoil comprising a stack of aerofoil sections from said inner end portion to said outer end portion thereof, said at least one end portion having a variation in said aerofoil sections wherein throughout at least a greater part of said boundary layer, said aerofoil sections have increased camber relative to conventional blade aerofoils in the case of both rotor and stator blades, with a small decrease in stagger in the case of a rotor blade and a large increase in stagger in the case of a stator blade whereby said at least one end portion produces a substantially constant lift force per unit aerofoil length and a change of fluid flow whirl velocity per unit aerofoil length which varies inversely with the fluid flow axial velocity.

4. A rotor or stator blade as claimed in claim 1, 2 or 3 characterised in that the aerofoil sections making up the blade are stacked about their centres of lift.

* * * * *